US012698916B2

(12) United States Patent
Nishimura et al.

(10) Patent No.: US 12,698,916 B2
(45) Date of Patent: Aug. 4, 2026

(54) COMMUNICATION UNIT, AIR TREATMENT APPARATUS, COMMUNICATION SYSTEM FOR AIR TREATMENT APPARATUS, AND COMMUNICATION METHOD FOR AIR TREATMENT APPARATUS

(71) Applicant: DAIKIN INDUSTRIES, LTD., Osaka (JP)

(72) Inventors: Masaya Nishimura, Osaka (JP); Atsushi Kondou, Osaka (JP); Nobuo Domyo, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/097,115

(22) Filed: Jan. 13, 2023

(65) Prior Publication Data

US 2023/0151991 A1 May 18, 2023

Related U.S. Application Data

(63) Continuation of application No. PCT/JP2021/026682, filed on Jul. 15, 2021.

(30) Foreign Application Priority Data

Jul. 16, 2020 (JP) ..... 2020-122200

(51) Int. Cl.

| | |
|---|---|
| ***G06F 11/30*** | (2006.01) |
| ***F24F 11/30*** | (2018.01) |
| ***F24F 11/58*** | (2018.01) |

(52) U.S. Cl.

CPC ..... *F24F 11/58* (2018.01); *F24F 11/30* (2018.01)

(58) Field of Classification Search

CPC ..... F24F 11/58

See application file for complete search history.

(56) References Cited

U.S. PATENT DOCUMENTS

2006/0180676 A1* 8/2006 Park ..... G05D 23/1905 340/541

2017/0193788 A1 7/2017 Kim et al.

(Continued)

FOREIGN PATENT DOCUMENTS

CN 104197482 A 12/2014

CN 105444350 A 3/2016

(Continued)

OTHER PUBLICATIONS

International Preliminary Report of corresponding PCT Application No. PCT/JP2021/026682 dated Jan. 26, 2023.

(Continued)

*Primary Examiner* — Phuong Huynh

(74) *Attorney, Agent, or Firm* — Spencer Fane LLP

(57) ABSTRACT

A communication unit is provided for an air treatment apparatus. The communication unit includes a receiver, a transmitter, and a storage. The receiver receives measurement data sent from a measuring apparatus separate from the air treatment apparatus. The measuring apparatus is movable. The transmitter transmits, to a server, the measurement data associated with specific information of the air treatment apparatus. The storage stores the measurement data therein. If a storage process in which the measurement data is stored in the storage is completed, the transmitter transmits, to the measuring apparatus, information indicating that the storage process has been completed.

12 Claims, 7 Drawing Sheets

(56) References Cited

U.S. PATENT DOCUMENTS

| | | | |
|---|---|---|---|
| 2017/0284690 | A1 | 10/2017 | Lipanov |
| 2021/0247086 | A1 | 8/2021 | Sasaki et al. |

FOREIGN PATENT DOCUMENTS

| | | | | |
|---|---|---|---|---|
| CN | 107702267 | A | 2/2018 | |
| JP | 2017-527051 | A | 9/2017 | |
| JP | 2019-60539 | A | 4/2019 | |
| WO | 2019/049363 | A1 | 3/2019 | |
| WO | WO-2020110424 | A1 * | 6/2020 | ..... F24F 11/36 |

OTHER PUBLICATIONS

European Search Report of corresponding EP Application No. 21 84 3298.7 dated Oct. 9, 2023.
International Search Report of corresponding PCT Application No. PCT/JP2021/026682 dated Oct. 19, 2021.

* cited by examiner

| IDENTIFYING INFORMATION OF AIR TREATMENT APPARATUS | INSTALLATION LOCATION OF AIR TREATMENT APPARATUS |
|---|---|
| A1 | FLOOR 1 OF BUILDING B |
| A2 | FLOOR 2 OF BUILDING C |
| ⋮ | ⋮ |

COMMUNICATION UNIT, AIR TREATMENT APPARATUS, COMMUNICATION SYSTEM FOR AIR TREATMENT APPARATUS, AND COMMUNICATION METHOD FOR AIR TREATMENT APPARATUS

CROSS-REFERENCE TO RELATED APPLICATIONS

This is a continuation of International Application No. PCT/JP2021/026682 filed on Jul. 15, 2021, which claims priority to Japanese Patent Application No. 2020-122200, filed on Jul. 16, 2020. The entire disclosures of these applications are incorporated by reference herein.

BACKGROUND

Technical Field

The present disclosure relates to a communication unit, an air treatment apparatus, a communication system for the air treatment apparatus, and a communication method for the air treatment apparatus.

Background Art

An apparatus disclosed in Japanese Translation of PCT International Application No. 2017-527051 includes an air quality measuring apparatus and a wireless terminal. The air quality measuring apparatus detects the types and concentrations of various gases, the temperature, the humidity, dust, and the like in air, and derives a measured value of air quality from the detected data of various types. The air quality measuring apparatus (measuring apparatus) transmits a measured value (measurement data) of air quality to the wireless terminal. The wireless terminal includes a display. The display displays the measured value of air quality, and an explanation of the situation and a countermeasure plan for the measured value of air quality.

SUMMARY

A first aspect of the present disclosure is directed to a communication unit. The communication unit is for an air treatment apparatus. The communication unit includes a receiver, a transmitter, and a storage. The receiver is configured to receive measurement data sent from a measuring apparatus separate from the air treatment apparatus. The measuring apparatus is movable. The transmitter is configured to transmit, to a server, the measurement data associated with specific information of the air treatment apparatus. The storage is configured to store the measurement data therein. If a storage process in which the measurement data is stored in the storage is completed, the transmitter is configured to transmit, to the measuring apparatus, information indicating that the storage process has been completed.

DETAILED DESCRIPTION OF EMBODIMENT(S)

Figure 1:
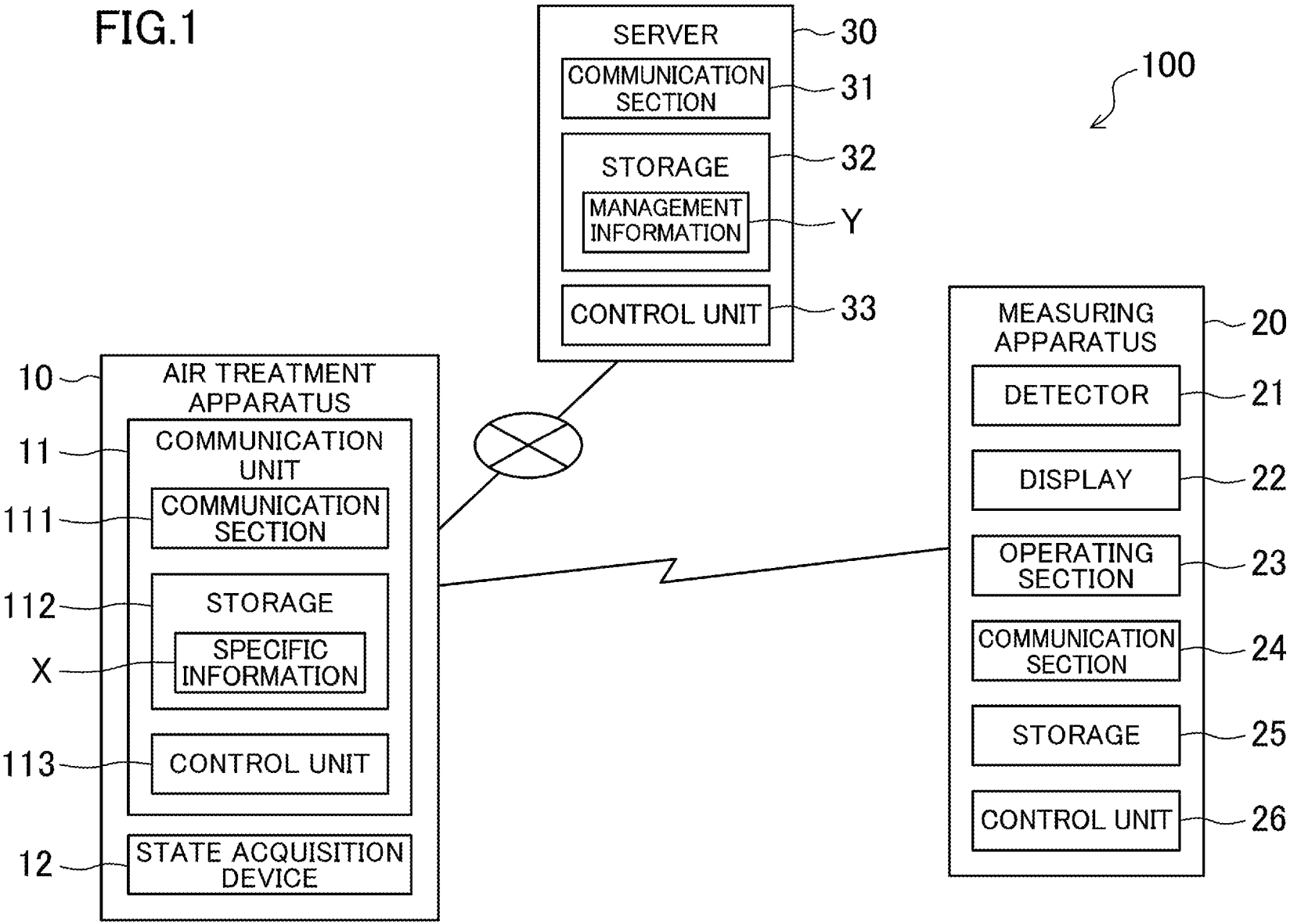
FIG. 1 is a block diagram showing the configuration of a communication system according to a first embodiment of the present disclosure.

Embodiments of the present disclosure will be described in detail with reference to the drawings. Note that like reference characters denote the same or equivalent components in the drawings, and the detailed description thereof, the description of advantages associated therewith, and other descriptions will not be repeated.

First Embodiment

A communication system (100) for an air treatment apparatus (10) according to a first embodiment of the present disclosure will be described with reference to FIG. 1. The communication system (100) for the air treatment apparatus (10) may be hereinafter referred to as the "communication system (100)." FIG. 1 is a block diagram showing a configuration of the communication system (100).

As shown in FIG. 1, the communication system (100) includes the air treatment apparatus (10), a measuring apparatus (20), and a server (30).

In the first embodiment, an air treatment apparatus (10) is an air conditioner including at least one of a heating function of raising the temperature of air or a cooling function of lowering the temperature of air. The air treatment apparatus (10) includes a communication unit (11) and a state acquisition device (12).

The communication unit (11) includes a communication section (111), a storage (112), and a control unit (113).

The communication section (111) includes a communication module, such as a local area network (LAN) board. The communication section (111) communicates with the server (30) via network, such as the Internet.

The communication section (111) further includes a wireless communication module for communicating with the measuring apparatus (20). The wireless communication module is, for example, an apparatus compatible with the near field communication standard, such as the Bluetooth low energy (BLE) (registered trademark) standard. In the first embodiment, the communication section (111) communicates with the measuring apparatus (20) via wireless communication for a horizontal communication distance not shorter than 2 m but not longer than 10 m. Consequently, the transmission of the measurement data from the measuring apparatus (20) to the communication unit (11) can be performed in such a way that the measurement data can be substantially prevented from being transmitted to a communication unit (11) of an air treatment apparatus (10) installed at a location well-distanced from the location where the measuring apparatus (20) performs a measurement (e.g., an air treatment apparatus (10) on another floor other than the floor on which the measuring apparatus (20) performs the measurement, in a building). Wireless communication with a bandwidth of 2.4 GHz or higher may be preferably employable for communication between the communication section (111) and the measuring apparatus (20). Specific examples of such wireless communication with a bandwidth of 2.4 GHz or higher include ultra wideband (UWB), ZigBee (registered trademark), and specified low power radio.

The communication section (111) is connected to the state acquisition device (12), and can communicate with the state acquisition device (12). The communication section (111) may include, for example, a communication port for wired connection to the state acquisition device (12) via the communication port and a communication cable connected to the communication port. The communication section (111) may be wirelessly connected to the state acquisition device (12) by using a mode of communication, such as Bluetooth (registered trademark) (including BLE) or wireless fidelity (Wi-Fi) (registered trademark).

The storage (112) includes a main memory (e.g., a semiconductor memory), such as a flash memory, a read only memory (ROM), and a random access memory (RAM), and may further include an auxiliary memory (e.g., a hard disk drive, a solid state drive (SSD), a secure digital (SD) memory card, or a universal seral bus (USB) flash memory). The storage (112) stores therein various computer programs executable by the control unit (113).

The storage (112) stores specific information (X) of the air treatment apparatus (10). The specific information (X) includes, for example, any one of floor level information on the floor level where the air treatment apparatus (10) is installed, positional information on the location where the air treatment apparatus (10) is installed, or identifying information on the air treatment apparatus (10). The floor level information indicates the floor level of a structure (e.g., a building) where the air treatment apparatus (10) is installed. The positional information indicates latitude, longitude, and altitude, or the location where the air treatment apparatus (10) is installed, such as a floor on the west side of the structure. The identifying information on the air treatment apparatus (10) includes, for example, at least one of ID information on the air treatment apparatus (10), serial number information on the air treatment apparatus (10), or a security key. The control unit (113) includes a processor, such as a central processing unit (CPU) or a microprocessor unit (MPU). The control unit (113) executes a computer program stored in the storage (112) so as to control elements of the communication unit (11).

The state acquisition device (12) includes, for example, a camera and/or a memory. The state acquisition device (12) monitors the state of the air treatment apparatus (10) to acquire state data representing the state of the air treatment apparatus (10).

The state data may include image data representing the state of the interior of the housing of the air treatment apparatus (10). In this case, the state acquisition device (12) includes a camera, which captures an image of the interior of the housing of the air treatment apparatus (10) so as to acquire the image data representing the state of the interior of the housing, as the state data.

The state data may include operation data on the air treatment apparatus (10) (such as histories of executions of operations on a cooling/heating operation menu and a history of turning on and off a thermostat). In this case, the state acquisition device (12) includes a memory, so that the acquisition of the operation data is performed by storing in the memory the operation data on the air treatment apparatus (10).

The operation data on the air treatment apparatus (10) may include, for example, a history of actions of an actuator included in the air treatment apparatus (10) or results detected by a sensor.

The state acquisition device (12) further includes a communication module for communicating with the communication unit (11), and is communicably connected to the communication unit (11) in a wired or wireless manner. The state acquisition device (12) transmits the acquired state data to the communication unit (11).

The communication unit (11) and the memory of the state acquisition device (12) may be independently a built-in apparatus provided inside the housing of the air treatment apparatus (10) or an external apparatus provided outside the housing of the air treatment apparatus (10). The communication unit (11) and the state acquisition device (12) may be provided in the air treatment apparatus (10) before shipped as a product, or may be retrofitted to the air treatment apparatus (10) after shipped as a product.

As shown in FIG. 1, the measuring apparatus (20) includes a detector (21), a display (22), an operating section (23), a communication section (24), a storage (25), and a control unit (26).

The detector (21) is a device having a function of sensing as to an environment. The detector (21) performs detection to obtain a measured value representing the environment in a target space (indoor) where the air treatment apparatus (10) treats air to generate measurement data indicating the measured value. In the first embodiment, the detector (21) detects the measured value representing at least one of the temperature, humidity, CO concentration, $CO_2$ concentration, dust concentration, airflow, illuminance, noise, or volatile organic compounds (VOC) concentration in the target space to generate measurement data indicating the measured value.

The display (22) includes a display panel, such as a liquid crystal panel. The display (22) displays, for example, an operation screen of the measuring apparatus (20) and information (measurement data) indicating the result detected by the detector (21). The operating section (23) receives an external instruction to the measuring apparatus (20). The operating section (23) may include, for example, a touch screen provided for the display (22), and operation buttons. The communication section (24) further includes a wireless communication module for communicating with the communication unit (11). The communication section (24) is, for example, a wireless communication module compatible with the near field communication standard, such as the Bluetooth low energy (BLE) standard (registered trademark). The communication section (24) is paired with the communication unit (11) so as to be wirelessly connected to the communication unit (11) using, for example, a USB dongle. The storage (25) includes a main memory, such as a flash memory, a ROM, or a RAM, and may further include an auxiliary memory. The storage (25) stores various computer programs executable by the control unit (26). The storage (25) includes a processor, such as a CPU or an MPU. The control unit (26) executes a computer program stored in the storage (25) so as to control elements of the measuring apparatus (20).

The measuring apparatus (20) is an apparatus separate from the air treatment apparatus (10), and is an apparatus movable. In other words, the measuring apparatus (20) is a portable apparatus. After carrying the measuring apparatus (20) to the target space, a measurer measures the target space using the measuring apparatus (20). As a result, the measuring apparatus (20) performs detection to obtain a measured value representing how the environment in the target space is. The measurement in the target space is regularly performed, for example, in conformity with rules (laws and regulations), such as the Act on Maintenance of Sanitation in Buildings (abbreviated as the Building Sanitation Management Act). The measurer is, for example, an operator of a maintenance agency, an operator of a measuring agency, or a user. What moves the measuring apparatus (20) is not limited to the measurer, but may be a self-propelled robot, for example.

Figures 2, 3:
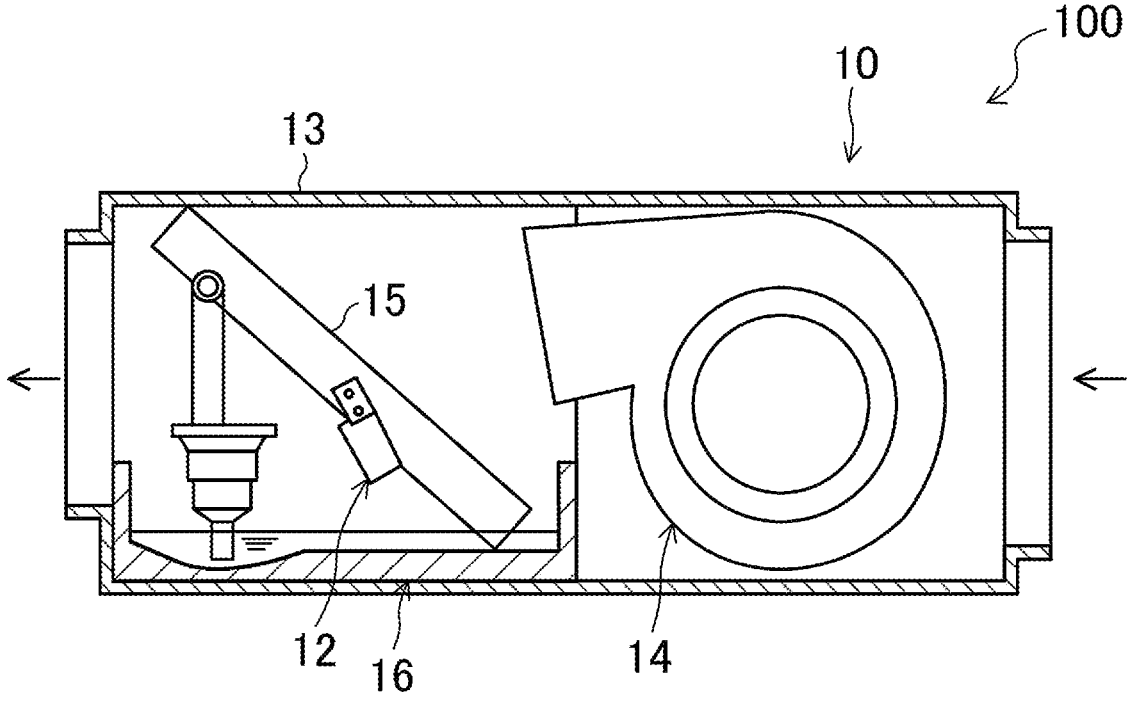
FIG. 2 shows management information.
FIG. 3 is a schematic cross-sectional view showing an example of each of an air treatment apparatus and a state acquisition device.

The server (30) manages the air treatment apparatus (10). The server (30) includes a communication section (31), a storage (32), and a control unit (33). The communication section (31) includes a communication module, such as a local area network (LAN) board. The communication section (31) communicates with the air treatment apparatus (10) via network, such as the Internet. The storage (32) includes a main memory, such as a flash memory, a ROM, or a RAM, and may further include an auxiliary memory. The storage (32) stores therein various computer programs executable by the control unit (33). The storage (32) stores therein management information (Y) for managing the air treatment apparatus (10). As shown in FIG. 2, the management information (Y) includes, for example, information including the identifying information on the air treatment apparatus (10) and information indicating the installation location of the air treatment apparatus (10) (such as the floor level information and the positional information) associated with each other. The control unit (33) includes a processor, such as a CPU and an MPU. The control unit (33) executes a computer program stored in the storage (32) to control elements of the server (30). The server (30) may be a single-tenant server, a virtual private server (VPS), or a cloud server distributed through the Internet.

An example of each of the air treatment apparatus (10) and the state acquisition device (12) will be described with reference to FIGS. 1 and 3. FIG. 3 is a schematic cross-sectional view showing an example of each of the air treatment apparatus (10) and the state acquisition device (12).

As shown in FIGS. 1 and 3, in the first embodiment, the state acquisition device (12) is a camera. The air treatment apparatus (10) includes a housing (13) for an indoor unit, a fan (14), a heat exchanger (15), and a drain pan (16). The housing (13) accommodates therein the fan (14), the heat exchanger (15), the drain pan (16), and the camera that serves as the state acquisition device (12). The fan (14) sends indoor air into the housing (13). The heat exchanger (15) performs heat exchange between the air sent into the housing (13) by the fan (14) and a refrigerant. The drain pan (16) receives condensed water generated near the heat exchanger (15). The state acquisition device (12) that is the camera captures an image of the drain pan (16) to acquire image data representing the state of the drain pan (16). Then, the state acquisition device (12) transmits the image data representing the state of the drain pan (16) to the communication unit (11). The image data representing the state of the drain pan (16) is an example of the state data on the air treatment apparatus (10).

Figure 4:
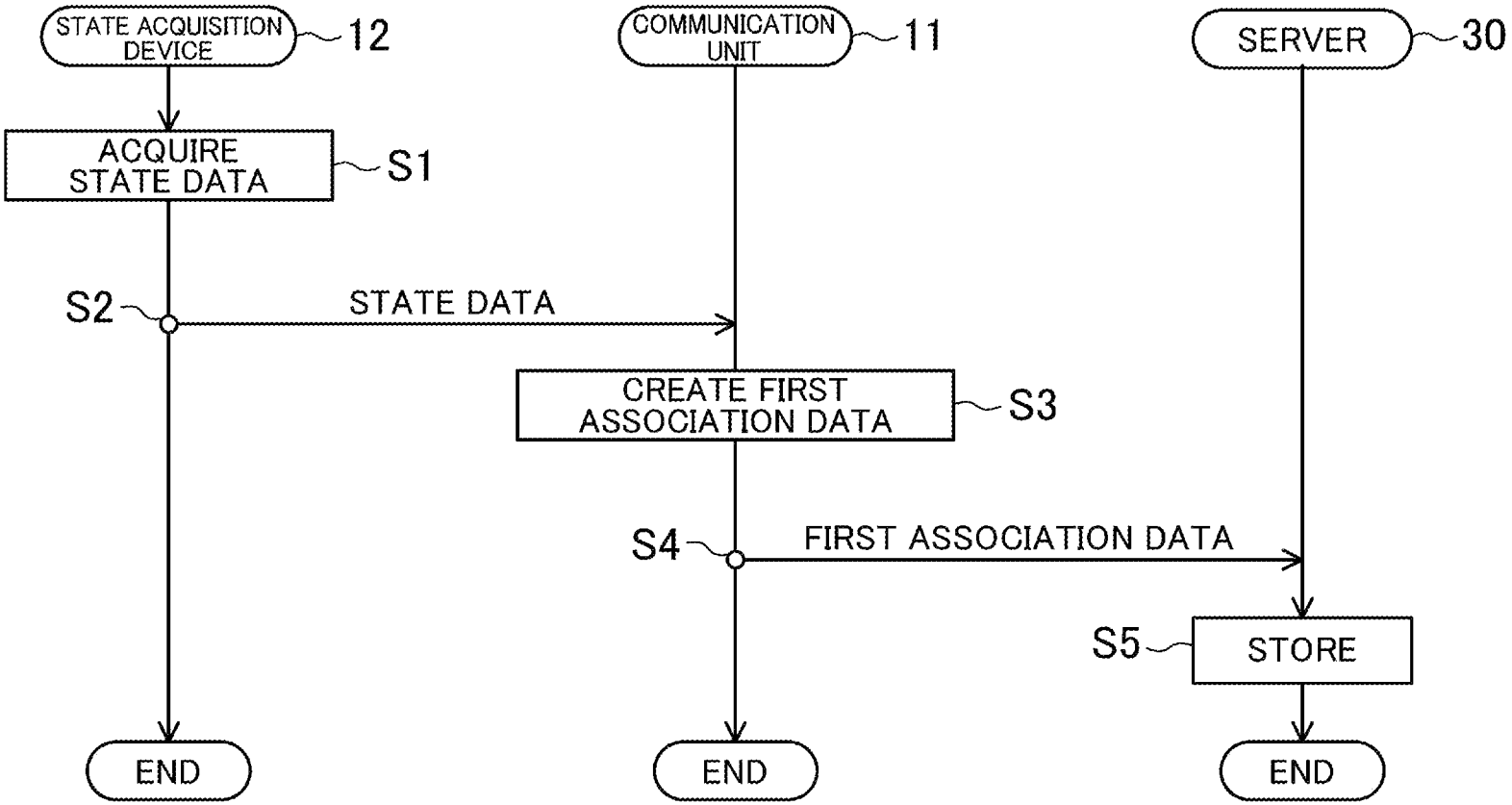
FIG. 4 is a flowchart showing a state data transmission process.

A state data transmission process will be described with reference to FIGS. 1 and 4. FIG. 4 is a flowchart showing the state data transmission process. The state data transmission process is a process to be performed so that the communication unit (11) transmits the state data on the air treatment apparatus (10) (more specifically, first association data including the state data) to the server (30).

As shown in FIGS. 1 and 4, in step S1, the state acquisition device (12) acquires the state data on the air treatment apparatus (10).

In step S2, the state acquisition device (12) transmits the state data on the air treatment apparatus (10) to the communication unit (11). As a result, the communication section (111) of the communication unit (11) receives the state data.

In step S3, the control unit (113) of the communication unit (11) adds the specific information (X) to the measurement data to create the first association data in which the specific information (X) is associated with the state data on the air treatment apparatus (10).

In step S4, the communication section (111) of the communication unit (11) transmits the first association data to the server (30). As a result, the communication section (31) of the server (30) receives the first association data.

In step S5, the storage (32) of the server (30) stores the first association data. Consequently, the state data transmission process ends. The server (30) manages the air treatment apparatus (10) based on the first association data.

In the first embodiment, the state acquisition device (12) acquires the state data on the air treatment apparatus (10) every predetermined period (e.g., every week or every month). Then, the state data transmission process shown in steps S1 to S5 is performed every predetermined period.

Figure 5:
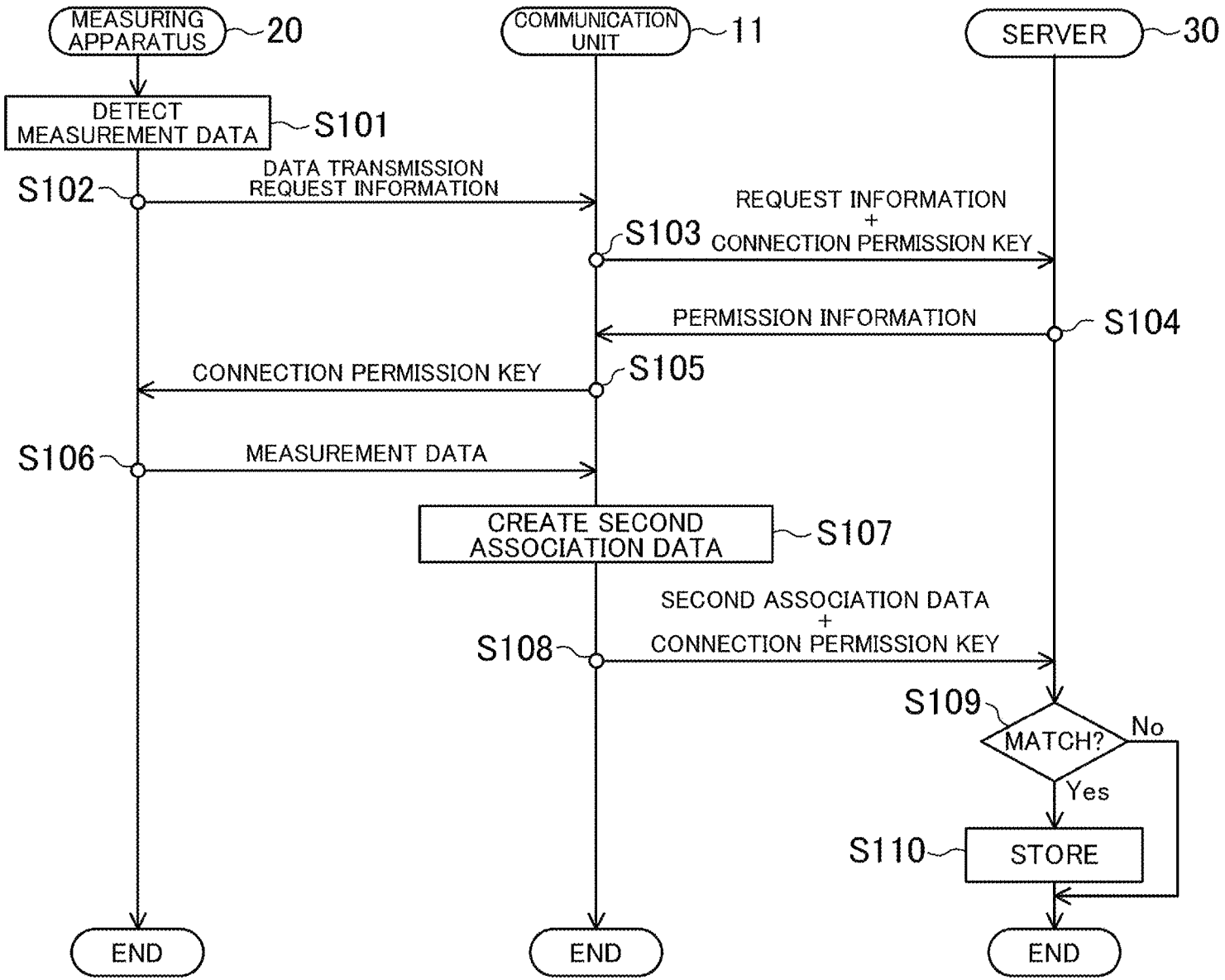
FIG. 5 is a flowchart showing a first example of a measurement data transmission process.

A first example of a measurement data transmission process will be described with reference to FIGS. 1 and 5. FIG. 5 is a flowchart showing the first example of the measurement data transmission process. The measurement data transmission process is a process to be performed so that the communication unit (11) transmits the measurement data of the measuring apparatus (20) (more specifically, second association data including the measurement data) to the server (30).

As shown in FIGS. 1 and 5, in step S101, the detector (21) of the measuring apparatus (20) detects the measured value representing the environment in the target space to generate the measurement data indicating the measured value. The target space indicates a space where the air treatment apparatus (10) performs air treatment, such as temperature control.

In step S102, the communication section (24) of the measuring apparatus (20) transmits data transmission request information to the communication unit (11). As a result, the communication section (111) of the communication unit (11) receives the data transmission request information.

The data transmission request information is information by which the measuring apparatus (20) requests the communication unit (11) to establish communicative connection with the measuring apparatus (20). The measuring apparatus (20) transmits the data transmission request information to perform the process of transmitting the measurement data to the communication unit (11).

In step S103, the communication section (111) of the communication unit (11) transmits request information and a connection permission key to the server (30). As a result, the communication section (31) of the server (30) receives the request information and the connection permission key.

The request information is information by which the communication unit (11) requests the server (30) to establish communicative connection with the communication unit (11). The communication unit (11) transmits the request information to perform the process of transmitting (uploading) the measurement data to the server (30). The connection permission key is information indicating that communicative connection between the measuring apparatus (20) and the communication unit (11) is permitted. The connection permission key may include encrypted cryptographic information, for example.

In step S104, the communication section (31) of the server (30) transmits permission information to the communication unit (11). Consequently, the communication section (111) of the communication unit (11) receives the permission information.

The permission information is a response to the request information, and is information indicating that communicative connection between the server (30) and the communication unit (11) is permitted.

In step S105, the communication section (111) of the communication unit (11) transmits, to the measuring apparatus (20), a connection permission key that is a response to the data transmission request information (see step S102). Consequently, the communication section (24) of the measuring apparatus (20) receives the connection permission key, and communicative connection is established between the measuring apparatus (20) and the communication unit (11). The establishment of the communicative connection means that it has become possible to transmit/receive a telegraphic message, such as the measurement data, and perform processes based on the telegraphic message (e.g., the processes shown in steps S106 to S108).

In step S106, the communication section (24) of the measuring apparatus (20) transmits the measurement data to the communication unit (11). As a result, the communication section (111) of the communication unit (11) receives the measurement data. For example, it may be so configured that, if the measuring apparatus (20) receives the connection permission key (see step S105), data-transmittable information indicating that the measurement data can be transmitted is displayed on the display (22) of the measuring apparatus (20). In this case, the measurer checks the display of the data-transmittable information on the display (22), and operates the operating section (23), so that the process shown in step S106 is performed. It may be so configured that, if the measuring apparatus (20) receives the connection permission key, the control unit (26) of the measuring apparatus (20) controls the communication section (24), not through the measurer's motion (operation of the operating section (23)), to perform the process shown in step S106.

In step S107, the control unit (113) of the communication unit (11) adds the specific information (X) to the measurement data to create the second association data in which the specific information (X) is associated with the measurement data.

In step S108, the communication section (111) of the communication unit (11) transmits the second association data and a connection permission key to the server (30). As a result, the communication section (31) of the server (30) receives the second association data and the connection permission key.

In step S109, the control unit (33) of the server (30) determines whether or not the connection permission key received together with the request information in step S103 matches the connection permission key received together with the second association data in step S108. If these connection permission keys match each other ("Yes" in step S109), the process proceeds to step S110. If these connection permission keys do not match each other, the first example of the measurement data transmission process ends. Note that if these connection permission keys do not match each other, the control unit (33) of the server (30) determines the second association data received in step S108 as being error data, which will not be employed in creation of a report described later.

In step S110, the storage (32) of the server (30) stores the second association data therein. Consequently, the first example of the measurement data transmission process ends.

Advantages of First Embodiment

As described above with reference to FIGS. 1 and 5, in step S108, the communication section (111) of the communication unit (11) transmits, to the server (30), the measurement data associated with the specific information (X) of the air treatment apparatus (10) (second association data). As a result, the control unit (33) of the server (30) can easily identify or estimate, based on the specific information (X), the location where the measuring apparatus (20) measures the measurement data. If the specific information (X) includes information indicating the installation location of the air treatment apparatus (10), such as the floor level information and the positional information, the control unit (33) of the server (30) specifies, as the location of measurement of the measurement data, information on the installation location of the air treatment apparatus (10) included in the specific information (X). If the specific information (X) consists of only the identifying information of the air treatment apparatus (10), the control unit (33) of the server (30) specifies, as the location of measurement of the measurement data, the installation location of the air treatment apparatus (10) associated with the identifying information of the air treatment apparatus (10) included in the specific information (X) in the management information (Y) stored in the storage (32) (see FIG. 2).

In step S107, the control unit (113) of the communication unit (11) associates the specific information (X) with the measurement data. This makes it easier to add information for identifying the location of measurement to the measurement data.

In addition, the control unit (33) of the server (30) can identify, based on the specific information (X), the location where the measuring apparatus (20) measures the measurement data. This allows the measurer to perform the task of measuring the measurement data without the need for performing the task of identifying the location of measurement of the measurement data (e.g., the task of creating information in which the measurement data is associated with the information indicating the location of measurement of the measurement data). As a result, the measurer can easily perform the task of measuring the measurement data. Moreover, when performing the task of managing the measurement data on the server (30), this configuration allows a manager for the server (30) to easily recognize, based on the specific information (X), where the measurement data is measured.

Creation of Report

The control unit (33) of the server (30) may create a report using the first association data stored in the storage (32) in the state data transmission process (see FIG. 4) (the state data associated with the specific information (X)) and the second association data stored in the storage (32) in the first example of the measurement data transmission process (see FIG. 5) (the measurement data associated with the specific information (X)). The report is data required to be submitted to a predetermined organization (e.g., a public organization, such as a health center) according to rules (laws and regulations), such as the Act on Maintenance of Sanitation in Buildings (abbreviated as the Building Sanitation Management Act).

The report includes the measurement data and the state data associated with the identical specific information (X).

The report further includes information indicating the location of measurement of the measurement data. In the report, information indicating the installation location of the air treatment apparatus (10) included in the inherent information (X) is employed as information indicating the location of measurement of the measurement data. If the specific information (X) consists of only the identifying information of the air treatment apparatus (10), and does not include the information indicating the installation location of the air treatment apparatus (10), the installation location of the air treatment apparatus (10) associated with the identifying information of the air treatment apparatus (10) in the management information (Y) (see FIG. 2) is used as the location of measurement of the measurement data in the report.

The state data included in the first association data (see FIG. 4) and the measurement data included in the second association data (see FIG. 5) are each associated with the specific information (X). Thus, the control unit (33) of the server (30) can easily identify the measurement data and the state data to be employed in creating the report, by comparing the specific information (X) associated with the measurement data to the specific information (X) associated with the state data. More specifically, the control unit (33) of the server (30) employs the measurement data and the state data including the identical specific information (X) as the data to be employed to create the report. As a result, the control unit (33) of the server (30) can easily create the report including the measurement data and the state data corresponding to the identical air treatment apparatus (10).

Conventionally, the measurer has been required to perform the task of recording the location of measurement of the measurement data every time the task of measuring the measurement data is performed. This has caused complication. However, in the first embodiment, the control unit (33) of the server (30) identifies the location of measurement of the measurement data, based on the specific information (X). This eliminates the need for the measurer to perform the task of recording the location of measurement of the measurement data. As a result, the report can be easily created.

Second Embodiment

Figure 6:
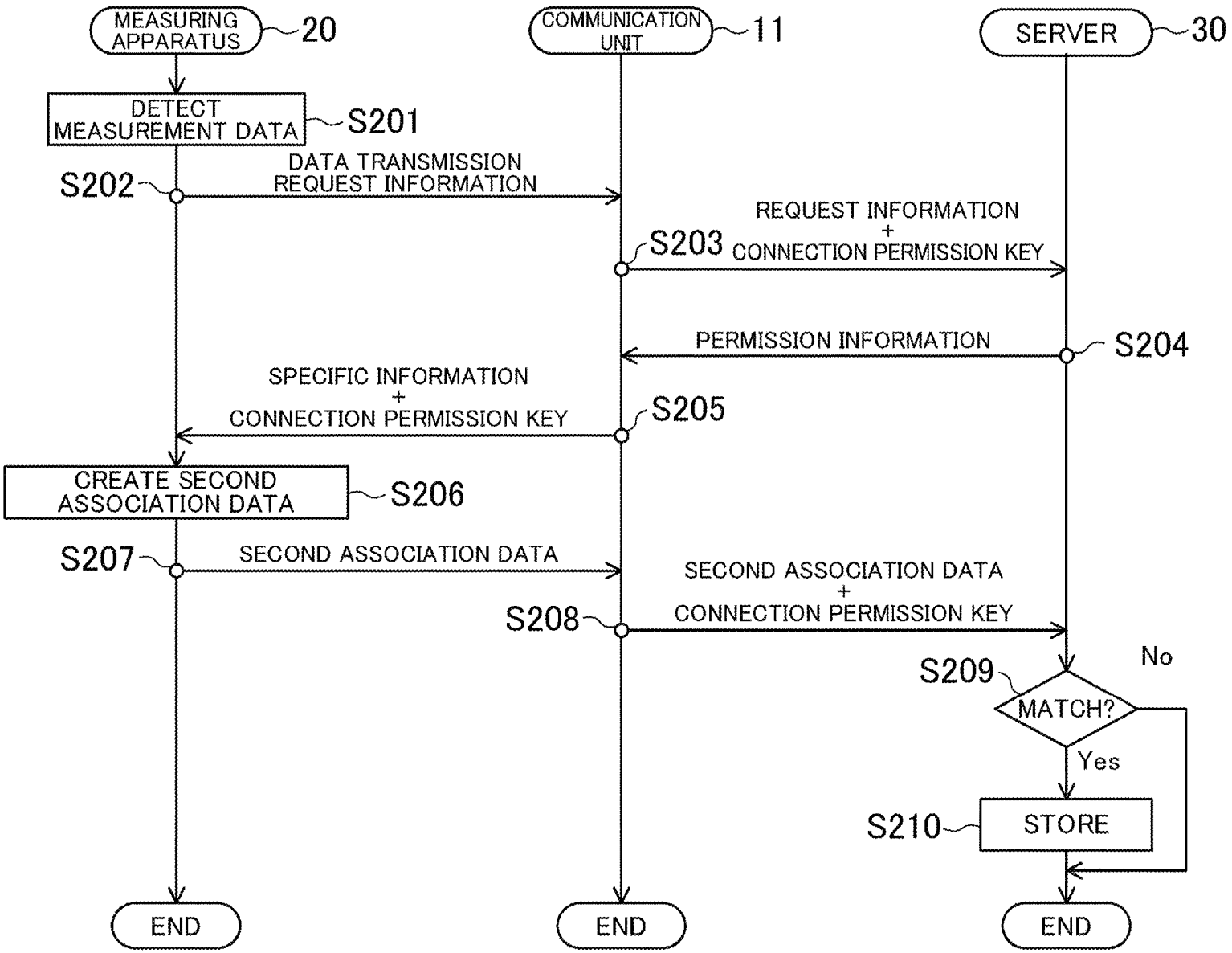
FIG. 6 is a flowchart showing a second example of the measurement data transmission process.

A second example of the measurement data transmission process will be described with reference to FIGS. 1 and 6. FIG. 6 is a flowchart showing the second example of the measurement data transmission process. In the first example of the measurement data transmission process, the communication unit (11) creates the second association data. In contrast, the second example of the measurement data transmission process is different from the first example in that the measuring apparatus (20) creates second association data.

As shown in FIGS. 1 and 6, in step S201, the detector (21) of the measuring apparatus (20) performs detection to obtain a measured value representing the environment in the target space to generate measurement data indicating the measured value.

In step S202, the communication section (24) of the measuring apparatus (20) transmits data transmission request information to the communication unit (11).

In step S203, the communication section (111) of the communication unit (11) transmits request information and a connection permission key to the server (30).

In step S204, the communication section (31) of the server (30) transmits permission information to the communication unit (11).

In step S205, the communication section (111) of the communication unit (11) transmits specific information (X) and a connection permission key to the measuring apparatus (20). Consequently, the communication section (24) of the measuring apparatus (20) receives the specific information (X) and the connection permission key.

In step S206, the control unit (26) of the measuring apparatus (20) associates the specific information (X) with the measurement data to create the second association data.

In step S207, the communication section (24) of the measuring apparatus (20) transmits the second association data to the communication unit (11). Consequently, the communication section (111) of the communication unit (11) receives the second association data.

In step S208, the communication section (111) of the communication unit (11) transmits the second association data and a connection permission key to the server (30).

In step S209, the control unit (33) of the server (30) determines whether or not the connection permission key received together with the request information in step S203 matches the connection permission key received together with the second association data in step S208. If these connection permission keys match each other ("Yes" in step S209), the process proceeds to step S210. If these connection permission keys do not match each other ("No" in step S209), the second example of the measurement data transmission process ends.

In step S210, the storage (32) of the server (30) stores the second association data. Consequently, the second example of the measurement data transmission process ends.

Advantages of Second Embodiment

As described above with reference to FIGS. 1 and 6, in step S207, the measuring apparatus (20) transmits the measurement data associated with the specific information (X) (second association data) to the communication unit (11). Thus, the communication section (111) of the communication unit (11) can transmit, to the server (30), the second association data as transmitted from the measuring apparatus (20) without data-processing the second association data as transmitted. As a result, the accuracy of the measurement data included in the second association data can be secured.

Third Embodiment

Figure 7:
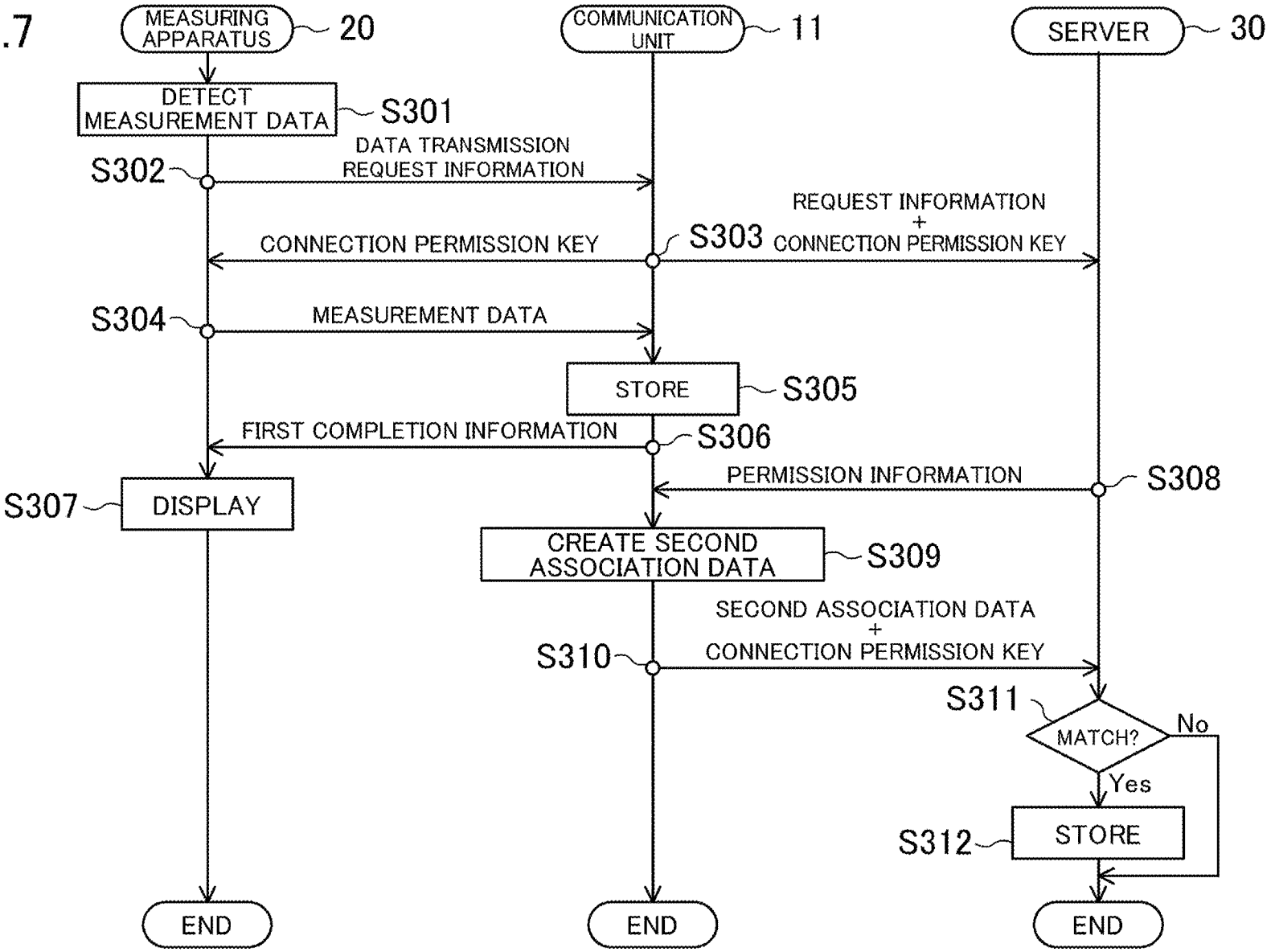
FIG. 7 is a flowchart showing a third example of the measurement data transmission process.

A third example of the measurement data transmission process will be described with reference to FIGS. 1 and 7. FIG. 7 is a flowchart showing the third example of the measurement data transmission process. The third example of the measurement data transmission process is a variation of the first example of the measurement data transmission process. In the first example of the measurement data transmission process (see FIG. 5), the measurement data cannot be transmitted from the measuring apparatus (20) to the communication unit (11) before the permission information (permission to upload measurement data to the server (30)) is transmitted from the server (30) to the measuring apparatus (20). In contrast, the third example of the measurement data transmission process is different from the first example in that, even before permission information is transmitted from the server (30) to the measuring apparatus (20), the measurement data can be transmitted from the measuring apparatus (20) to the communication unit (11).

As shown in FIGS. 1 and 7, in step S301, the detector (21) of the measuring apparatus (20) performs detection to obtain a measured value representing the environment in the target space to generate the measurement data indicating the measured value.

In step S302, the communication section (24) of the measuring apparatus (20) transmits data transmission request information to the communication unit (11).

In step S303, the communication section (111) of the communication unit transmits a connection permission key to the measuring apparatus (20), and transmits request information and another connection permission key to the server (30). Consequently, the communication section (24) of the measuring apparatus (20) receives the connection permission key, and the communication unit (31) of the server (30) receives the request information and the another connection permission key.

In step S304, the communication section (24) of the measuring apparatus (20) transmits the measurement data to the communication unit (11).

In step S305, the storage (112) of the communication unit (11) stores the measurement data therein.

In step S306, the communication section (111) of the communication unit (11) transmits first completion information to the measuring apparatus (20). Consequently, the communication section (24) of the measuring apparatus (20) receives the first completion information. The first completion information is information indicating that the process of storing the measurement data in the storage (112) of the communication unit (11) has been completed.

In step S307, the display (22) of the measuring apparatus (20) displays the first completion information. As a result, even before the measurement data is transmitted to the server (30), the measurer can check what is displayed on the display (22), thereby being able to recognize that the measuring apparatus (20) has completed the task of measuring the measurement data.

In step S308, the communication section (31) of the server (30) transmits permission information to the communication unit (11).

In step S309, the control unit (113) of the communication unit (11) associates the specific information (X) with the measurement data to create second association data.

In step S310, the communication section (111) of the communication unit (11) transmits the second association data and a connection permission key to the server (30).

In step S311, the control unit (33) of the server (30) determines whether or not the connection permission key received together with the request information in step S303 matches the connection permission key received together with the second association data in step S310. If these connection permission keys match each other ("Yes" in step S311), the process proceeds to step S312. If these connection permission keys do not match each other ("No" in step S311), the third example of the measurement data transmission process ends.

In step S312, the storage (32) of the server (30) stores the second association data therein. Consequently, the third example of the measurement data transmission process ends.

Advantages of Third Embodiment

As described above with reference to FIGS. 1 and 7, in step S305, the storage (112) of the communication unit (11) stores the measurement data therein. Thus, the communication section (111) of the communication unit (11) can transmit the measurement data to the server (30) in conformity with the regular timing of communication. In addition, the communication section (111) of the communication unit (11) transmitting the measurement data to the server (30) in conformity with the regular timing of communication can reduce the frequency of communication between the communication unit (11) and the server (30), resulting in a reduction in communication expenses.

The storing the measurement data in the storage (112) eliminates the need that at every reception of the measurement data from the measuring apparatus (20), the communication unit (11) should transmit the received measurement data to the server (30). Thus, the measurement data can be transmitted to the server (30) in a time period during which the line is not busy or at the timing when other pieces of data (e.g., state data (image data on a drain pan camera image)) are transmitted to the server (30). As a result, the measurement data can be efficiently transmitted to the server (30).

If, in step S305, the storage process of storing the measurement data in the storage (112) of the communication unit (11) is completed, the communication section (111) of the communication unit (11) transmits the first completion information indicating that the storage process has been completed to the measuring apparatus (20) in step S306. Thus, the measurer checking that the measuring apparatus (20) has received the first completion information can recognize that the measurement data has been stored in the storage (112) of the communication unit (11). As a result, the measurer does not need to wait at the location of measurement until the measurement data is transmitted to the server (30). Thus, if the task of transmitting the measurement data from the measuring apparatus (20) to the communication unit (11) is completed, the measurement task can be ended.

In step S303, the communication section (111) of the communication unit (11) transmits to the measuring apparatus (20) the connection permission key (connection permission information) indicating that communicative connection with the communication unit (11) is permitted, and transmits to the server (30) the request information requesting the server (30) to establish communicative connection with the communication unit (11). According to this configuration, the communication unit (11) can acquire the measurement data from the measuring apparatus (20) without waiting for the server (30) to make a response of communication permission (permission information) to the request information (see steps S304 and S308 in FIG. 7). Thus, even while it is difficult for the communication unit (11) to communicate with the server (30) due to the busy telecommunication line between the server (30) and the communication unit (11), the measurer can cause the measuring apparatus (20) to transmit the measurement data to the communication unit (11). As a result, the measurer can perform the task of transmitting the measurement data from the measuring apparatus (20) without waiting until recovery of the state of communication between the server (30) and the communication unit (11). Thus, the measurement data can be easily transmitted.

Fourth Embodiment

Figure 8:
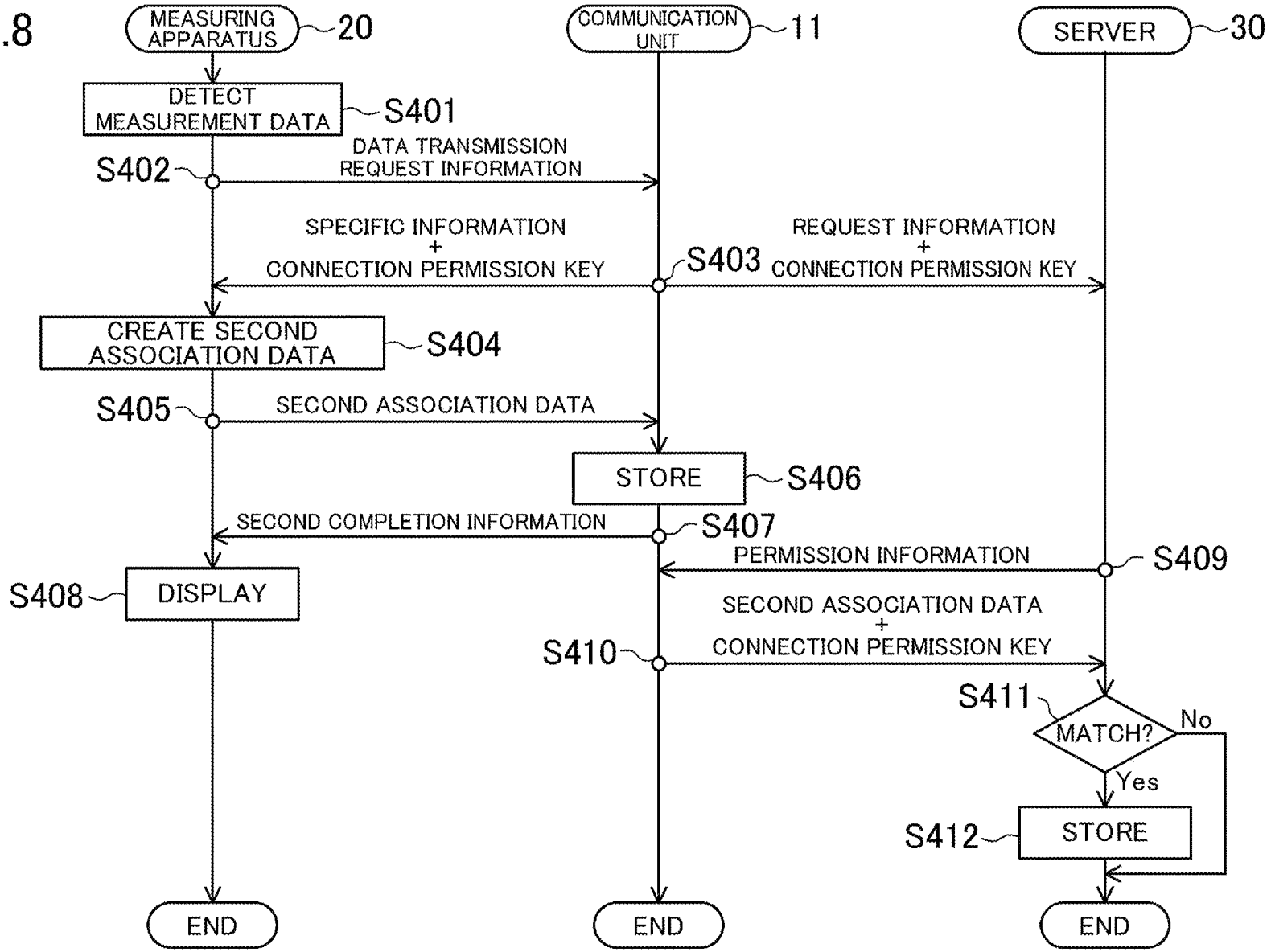
FIG. 8 is a flowchart showing a fourth example of the measurement data transmission process.

A fourth example of the measurement data transmission process will be described with reference to FIGS. 1 and 8. FIG. 8 is a flowchart showing the fourth example of the measurement data transmission process. The fourth example of the measurement data transmission process is a variation of the second example of the measurement data transmission process. In the second example of the measurement data transmission process (see FIG. 6), before permission information is transmitted from the server (30) to the measuring apparatus (20), the second association data (the measurement data and the specific information (X)) cannot be transmitted from the measuring apparatus (20) to the communication unit (11). In contrast, the fourth example of the measurement data transmission process is different from the second example in that, even before permission information is transmitted from the server (30) to the measuring apparatus (20), the second association data can be transmitted from the measuring apparatus (20) to the communication unit (11).

As shown in FIGS. 1 and 8, in step S401, the detector (21) of the measuring apparatus (20) performs detection to obtain a measured value representing the environment in the target space to generate measurement data indicating the measured value.

In step S402, the communication section (24) of the measuring apparatus (20) transmits data transmission request information to the communication unit (11).

In step S403, the communication section (111) of the communication unit (11) transmits specific information (X) and a connection permission key to the measuring apparatus (20), and transmits request information and another connection permission key to the server (30). Consequently, the communication section (24) of the measuring apparatus (20) receives the specific information (X) and the connection permission key, and the communication section (31) of the server (30) receives the request information and the another connection permission key.

In step S404, the control unit (26) of the measuring apparatus (20) associates the specific information (X) with the measurement data to create the second association data.

In step S405, the communication section (24) of the measuring apparatus (20) transmits the second association data to the communication unit (11).

In step S406, the storage (112) of the communication unit (11) stores the second association data therein.

In step S407, the communication section (111) of the communication unit (11) transmits second completion information to the measuring apparatus (20). As a result, the communication section (24) of the measuring apparatus (20) receives the second completion information. The second completion information is information indicating that the process of storing the second association data in the storage (112) of the communication unit (11) has been completed.

In step S408, the display (22) of the measuring apparatus (20) displays the second completion information. As a result, even before the second association data including the measurement data is transmitted to the server (30), the measurer can check what is displayed on the display (22), thereby being able to recognize that the measuring apparatus (20) has completed the task of measuring the measurement data.

In step S409, the communication section (31) of the server (30) transmits permission information to the communication unit (11).

In step S410, the communication section (111) of the communication unit (11) transmits the second association data and a connection permission key to the server (30).

In step S411, the control unit (33) of the server (30) determines whether or not the connection permission key received together with the request information in step S403 matches the connection permission key received together with the second association data in step S410. If these connection permission keys match each other ("Yes" in step S411), the process proceeds to step S412. If these connection permission keys do not match each other ("No" in step S411), the fourth example of the measurement data transmission process ends.

In step S412, the storage (32) of the server (30) stores therein the second association data. Consequently, the fourth example of the measurement data transmission process ends.

Advantages of Fourth Embodiment

The fourth embodiment has advantages similar to those of each of the second and third embodiments. Thus, the advantages are not described.

Other Embodiments

It will be understood that the embodiments and variations thereof, which have been described so far, may be modified in configurations and details without departing from the spirit and scope of the claims (e.g., (1) to (10)). The embodiments and the variations thereof may be modified by combining or replacing their elements as appropriate, as long as the intended functions of the subject matter of the present disclosure is not impaired.

(1) In each of the second to fourth embodiments, just like the first embodiment, the control unit (33) of the server (30) may create a report using the first association data stored in the storage (32) in the state data transmission process (see FIG. 4) and the second association data stored in the storage (32) in each of the second and third examples of the measurement data transmission process (see FIGS. 6 to 8).

(2) In the third embodiment (see FIG. 7), the measurement data is stored in the storage (112) (see step S305). However, the present disclosure is not limited to this. It may be so configured that, if the communication section (111) of the communication unit (11) receives the measurement data (see step S304), the control unit (113) of the communication unit (11) creates the second association data and stores the created second association data in the storage (112).

(3) In each of step S103 of the first embodiment (see FIG. 5), step S203 of the second embodiment (see FIG. 6), step S303 of the third embodiment, and step S403 of the fourth embodiment, the specific information (X) may be transmitted together with the request information from the communication unit (11) to the server (30). In other words, in each of steps S103, S203, S303, and S403, instead of the connection permission key, the specific information (X) may be transmitted to the server (30).

In this case, in each of step S108 of the first embodiment, step S208 of the second embodiment, step S310 of the third embodiment, and step S410 of the fourth embodiment, the transmission of the second association data from the communication unit (11) to the server (30) may be performed without the transmission of the connection permission key.

In this case, in each of step S109 of the first embodiment (see FIG. 5), step S209 of the second embodiment (see FIG. 6), step S311 of the third embodiment, and step S411 of the fourth embodiment, a determination is made whether or not the specific information (X) transmitted together with the request information matches the specific information (X) included in the second association data. If these pieces of the specific information (X) match each other ("Yes" in each of steps S109, S209, S311, and S411), the second association data is stored in the storage (32) of the server (30) (see steps S110, S210, S312, and S412). In contrast, if these pieces of the specific information (X) do not match each other ("No"

in each of steps S109, S209, S311, and S411), the process (the measurement data transmission process of the first to fourth examples) ends.

(4) In each of the first to fourth embodiments, a configuration for pairing the communication unit (11) with the measuring apparatus (20) is not specifically limited. For example, it may be so configured that, if a plurality of communication units (11) of air treatment apparatuses (10) located within the communications radius of the communication section (24) of the measuring apparatus (20) are displayed on the display (22) of the measuring apparatus (20), the measurer operates the operating section (23) to select a communication unit (11) for establishing communicative connection with the measuring apparatus (20) from among the plurality of communication units (11). In this case, the measurer may select a communication unit (11) closest to the measuring apparatus (20) from among the plurality of communication units (11). Further, the process of selecting a communication unit (11) for establishing communicative connection with the measuring apparatus (20) may be performed not by the measurer but by the control unit (26) of the measuring apparatus (20). In this case, the control unit (26) of the measuring apparatus (20) may select a communication unit (11), for example, according to a predetermined control program so programmed as to select a communication unit (11) closest to the measuring apparatus (20).

The storage (25) of the measuring apparatus (20) may store therein such an application (App) that, if the communication unit (11) is located within the communications radius of the communication section (24) of the measuring apparatus (20), the application activates the communication section (24) to start access for transmitting the measurement data to the communication unit (11).

(5) In each of the first to fourth embodiments, the configuration that allows the measuring apparatus (20) to communicate with the communication unit (11) is not specifically limited. The measuring apparatus (20) may be wirelessly connected to the communication unit (11) by using a communication mode, such as near field communication (NFC), Bluetooth (a registered trademark), wireless fidelity (Wi-Fi) (registered trademark), ZigBee (registered trademark), or the infrared data association (Ir DA).

The first to fourth embodiments may be so configured that, the measurement data transmission process of the first to fourth examples (see FIGS. 5 to 8) is performed in such a way that the measurer manually establishes wired connection between the communication section (24) of the measuring apparatus (20) and the communication section (111) of the communication unit (11) via a communication cable or any other element to enable wired communication between the measuring apparatus (20) and the communication unit (11).

(6) The air treatment apparatus may have a configuration for at least one of a humidity control apparatus, a ventilator, or an air cleaner. The humidity control apparatus controls the humidity of air in a target space. The ventilator ventilates the target space. The air cleaner purifies air in the target space.

(7) The server (30) may be capable of storing the received measurement data in the file format that the measurement data has at the time of reception. As a result, in each of step S110 (see FIG. 5), step S210 (see FIG. 6), step S312 (see FIG. 7), and step S412 (see FIG. 8), the validity of the measurement data stored in the storage (25) of the server (30) can be effectively secured.

(8) The ordinal numbers such as "first," "second," "third," . . . , described above are used to distinguish the terms to which these expressions are given, and do not limit the number and order of the terms.

(9) The first embodiment illustrated in FIG. 5 may be modified such that, after the communication unit (11) receives the measurement data (see step S106), the process in which the measurement data is stored in the storage (112) of the communication unit (11), the process in which the first completion information is transmitted from the communication unit (11) to the measuring apparatus (20), and the process in which the first completion information is displayed on the display (22) of the measuring apparatus (20) are performed. In other words, the first embodiment may be modified such that, after the process shown in step S106 (see FIG. 5) is performed, the processes shown in steps S305 to S307 (see FIG. 7) are performed. As a result, even before the measurement data is transmitted to the server (30), the measurer can check what is displayed on the display (22), thereby being able to recognize that the measuring apparatus (20) has completed the transmission of the measurement data to the communication unit (11), and end the measurement task.

(10) The second embodiment illustrated in FIG. 6 may be modified such that, after the communication unit (11) receives the second association data (see step S207), the process in which the second association data is stored in the storage (112) of the communication unit (11), the process in which the second completion information is transmitted from the communication unit (11) to the measuring apparatus (20), and the process in which the second completion information is displayed on the display (22) of the measuring apparatus (20) are performed. In other words, the second embodiment may be modified such that, after the process shown in step S207 (see FIG. 6) is performed, the processes shown in steps S406 to S408 (see FIG. 8) are performed. As a result, even before the measurement data is transmitted to the server (30), the measurer can check what is displayed on the display (22), thereby being able to recognize that the measuring apparatus (20) has completed the transmission of the second association data to the communication unit (11), and end the measurement task.

As can be seen from the foregoing description, the present disclosure is usefully applicable to a communication unit, an air treatment apparatus, a communication system for the air treatment apparatus, and a communication method for the air treatment apparatus

The invention claimed is:

1. A communication unit for an air treatment apparatus, the communication unit comprising:

a receiver configured to receive measurement data sent from a measuring apparatus separate from the air treatment apparatus, the measuring apparatus being movable;

a transmitter configured to transmit, to a server, the measurement data associated with specific information of the air treatment apparatus, the specific information including at least one of: information indicating an installation location of the air treatment apparatus, where the air treatment apparatus is installed; and identifying information of the air treatment apparatus that is associated with the information indicating the installation location of the air treatment apparatus; and a storage configured to store therein the measurement data received by the receiver, the measuring apparatus being a portable apparatus and capable of being carried or self-propelled to a target space to perform detection to obtain a measured value representing how an environment in the target space is, the target space being a space in which the air treatment apparatus treats air, the measuring apparatus or the communication unit of the air treatment apparatus being configured to generate the measurement data associated with the specific information, upon completing a storage process in which the measurement data is stored in the storage, irrespective of whether the measurement data has already been transmitted from the air treatment apparatus to the server, the transmitter being configured to transmit, to the measuring apparatus, information indicating that the storage process has been completed, the receiver, the transmitter, and the storage being disposed in the communication unit, and the air treatment apparatus being disposed externally of the server, the measurement data being transmitted from the measuring apparatus to the server via the communication unit of the air treatment apparatus, the air treatment apparatus being an air conditioner, the air treatment apparatus including a housing, and the server and the measuring apparatus being disposed externally of the housing of the air treatment apparatus, and the server being configured to identify or estimate a measurement location based on the specific information associated with the measurement data, and to identify, as the measurement location, an installation location of the air treatment apparatus indicated by the specific information.

2. The communication unit of claim 1, wherein the transmitter is configured to transmit the specific information to the measuring apparatus, and the receiver is configured to receive the measurement data associated with the specific information transmitted from the measuring apparatus.

3. The communication unit of claim 1, wherein the receiver is further configured to receive state data representing a state of the air treatment apparatus from a state acquisition device of the air treatment apparatus, and the transmitter is further configured to transmit the state data associated with the specific information to the server.

4. The communication unit of claim 3, wherein the state data includes image data representing a state of an interior of the air treatment apparatus.

5. The communication unit of claim 1, further comprising:

a control unit configured to add the specific information to the measurement data to associate the measurement data with the specific information.

6. The communication unit of claim 1, wherein the communication with the measuring apparatus is performed via wireless communication over a horizontal communication distance not shorter than 2 m but not longer than 10 m.

7. The communication unit of claim 1, wherein the specific information of the air treatment apparatus further includes floor level information on a floor level where the air treatment apparatus is installed.

8. The communication unit of claim 1, wherein the receiver is configured to receive, as the measurement data, data representing at least one of a temperature, a humidity, a CO concentration, a $CO_2$ concentration, a dust concentration, an airflow, an illuminance, noise, and a VOC concentration in a target space where the air treatment apparatus treats air.

9. A communication system including the communication unit of claim 1, the communication system being for an air treatment apparatus, the communication system further comprising:

the server; and the measuring apparatus.

10. The communication system of claim 9, wherein the measuring apparatus includes a communication section configured to communicate with the communication unit, and an operating section configured to receive an input of selecting, from a plurality of the communication units located within a communications radius of the communication section, a communication unit in order to establish communicative connection with the measuring apparatus, and the measurement data from the measuring apparatus is associated with the specific information of the air treatment apparatus including the communication unit selected by the operating section.

11. The communication system of claim 9, wherein the measuring apparatus includes a communication section configured to communicate with the communication unit, and a control unit configured to select, from a plurality of the communication units located within a communications radius of the communication section, a communication unit in order to establish communicative connection with the measuring apparatus, and the measurement data from the measuring apparatus is associated with the specific information of the air treatment apparatus including the communication unit selected by the control unit.

12. A communication method using a communication unit provided for an air treatment apparatus, the communication method comprising:

a receiver of the communication unit receiving measurement data transmitted from a measuring apparatus separate from the air treatment apparatus, the measuring apparatus being movable, the measuring apparatus being a portable apparatus and capable of being carried or self-propelled to a target space to perform detection to obtain a measured value representing how an environment in the target space is, the target space being a space in which the air treatment apparatus treats air;

a control unit of the communication unit adding specific information of the air treatment apparatus to the measurement data to associate the measurement data with the specific information, the specific information including at least one of: information indicating an installation location of the air treatment apparatus, where the air treatment apparatus is installed; and identifying information of the air treatment apparatus that is associated with the information indicating the installation location of the air treatment apparatus;

a transmitter of the communication unit transmitting, to the server, the measurement data associated with the specific information;

storing the measurement data in a storage of the communication unit; and the transmitter of the communication unit transmitting completion information indicating that a storage process in which the measurement data are stored in the storage has been completed to the measuring apparatus irrespective of whether the measurement data has already been transmitted from the air treatment apparatus to the server, the measuring apparatus or the communication unit of the air treatment apparatus being configured to generate the measurement data associated with the specific information, the receiver, the transmitter, and the storage being disposed in the communication unit, and the air treatment apparatus being disposed externally of the server, the measurement data being transmitted from the measuring apparatus to the server via the communication unit of the air treatment apparatus, the air treatment apparatus being an air conditioner, the air treatment apparatus including a housing, and the server and the measuring apparatus being disposed externally of the housing of the air treatment apparatus, and the server being configured to identify or estimate a measurement location based on the specific information associated with the measurement data, and to identify, as the measurement location, the installation location of the air treatment apparatus indicated by the specific information.

* * * * *